US005092431A

United States Patent [19]

Schroder, deceased

[11] Patent Number: 5,092,431

[45] Date of Patent: Mar. 3, 1992

[54] GROUP CONTROL FOR ELEVATORS WITH IMMEDIATE ALLOCATION OF TARGET CALLS IN DEPENDENCE ON THE HALL CALL ENTRY LOCATION

[75] Inventor: Joris Schroder, deceased, late of Luzern, Switzerland, by Margrit Meyer, executor

[73] Assignee: Inventio AG, Switzerland

[21] Appl. No.: 650,088

[22] Filed: Feb. 4, 1991

[30] Foreign Application Priority Data

Feb. 5, 1990 [CH] Switzerland ..... 00 358/90

[51] Int. Cl.[5] ..... B66B 1/14

[52] U.S. Cl. ..... 187/127; 187/121; 187/137

[58] Field of Search ..... 187/121, 127, 137

[56] References Cited

U.S. PATENT DOCUMENTS 4,064,971 12/1977 Iwasaka et al. ..... 187/137
4,685,538 8/1987 Kamaike ..... 187/121
4,852,695 8/1989 Ostrowiecki ..... 187/127
4,878,562 11/1989 Schroder ..... 187/127
4,915,197 4/1990 Schroder ..... 187/121
4,991,694 2/1991 Friedli ..... 187/127

*Primary Examiner*—A. D. Pellinen
*Assistant Examiner*—Lawrence E. Colbert
*Attorney, Agent, or Firm*—William J. Clemens

[57] ABSTRACT

A group control selects the cars of an elevator group for boarding passengers such that the passenger arrive at the shaft door of the selected elevator earlier than the selected car whereby unnecessarily long stops are avoided. A memory for the storage of times needed by a passenger for traversing the paths between the respectively actuated call registering and indicating device and the shaft doors of the elevator is provided for each elevator. A comparator connected to the memory compares the passenger traverse time with the travelling time of the car to the call input floor. If the travelling time is less than the time needed by the passenger to move to the shaft door, a switching device connected to the output of the comparator becomes effective to exclude the elevator from the call allocation procedure.

5 Claims, 3 Drawing Sheets

GROUP CONTROL FOR ELEVATORS WITH IMMEDIATE ALLOCATION OF TARGET CALLS IN DEPENDENCE ON THE HALL CALL ENTRY LOCATION

BACKGROUND OF THE INVENTION

The present invention relates generally to group controls for elevators and, in particular, to an apparatus for the immediate allocation of target calls in dependence on the location of the call entry device on a floor.

Elevator group controls are known which have call registering and indicating devices located on the floors served by the elevator cars and include a keyboard for the entry of calls for desired target floors. Floor call memories, which are associated with the elevators of the 15 group and connected with the call registering and indicating devices respond to the entry of a call at a floor by storing a call identifying the entry floor and a call identifying the target floor Load memories are also provided in which the number of the persons present in the respective elevator car is stored for each floor. Travelling time memories and car position registers are associated with the elevator cars of the group for storing the travel time between the floors and the current position of the car respectively.

A group control, which is similar to the present invention and which uses the least waiting time of all passengers as the criterion for the allocation of the cars to the entered calls, is shown in the European Patent Application No. EP-A 0 356 731. In this control, the travel targets can be entered at the floors, for example, through the use of the call registering and indicating devices shown in the European Patent Application No. EP-A 0 320 583. Immediately after the registration and transmission of a call into a floor call memory divided according to entry and target floors, a computer in the form of a microprocessor ascertains a sum for each car from data specific to that elevator car, which sum is called operating costs and corresponds to the waiting time which would occur for the passengers should the call be served. The operating costs are transferred immediately after the computation into a costs register and then compared immediately with the operating costs of the other elevators by means of a comparison device. In this case an allocation instruction is stored in an allocation memory of that elevator which displays the least operating costs. Immediately after the allocation of a car to the call, the elevator concerned and its position are indicated in an indicating field of the actuated call registering and indicating device so that the passenger can move to the associated shaft door in time before the elevator car arrives.

Optimum results in respect of the lowest waiting times of the passengers can be achieved by the aforedescribed group control. In larger installations with several elevators however, it must be recognized that a passenger needs more or less time for travelling the path to the shaft door of the allocated elevator according to the relative position of the actuated call registering and indicating device on the floor. For this reason, after arrival at the floor, the door of the elevator must be kept open sufficiently long so that the passenger positioned the longest distance away can still board. In the case of a car arriving early, there results not only a loss of time for the persons situated in the car, but also for the entire elevator control system so that the operating quality and quantity is impaired.

The present invention is based on the task of improving the above described elevator group control in such a manner that cars in which a loss of time would arise through doors being kept open for too long a time are excluded from the call allocation.

SUMMARY OF THE INVENTION

The present invention concerns an apparatus for allocating elevator cars to target calls based upon the location of the passenger entering the call in relation to the elevator shaft doors. A memory is provided for each elevator for storing the times which a passenger needs for traversing the paths between the respectively actuated call registering and indicating devices and the shaft doors of the elevators. A comparator is connected with the memory for comparing the passenger movement time associated with the actuated call registering and indicating device with the travelling time of the car to the call entry floor. If the travelling time is smaller than the time needed by the passenger to get to the shaft door of the elevator concerned a switching device connected to the output of the comparator becomes effective in such a manner that the operating costs cannot be fed to a comparison device and the elevator concerned is excluded from the call allocation.

The advantages achieved by the invention are that a passenger always reaches the shaft door of the selected elevator before the arrival of the car so that no additional time losses for the entire system arise and the operating quality achievable by the applied call allocation method is not impaired.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
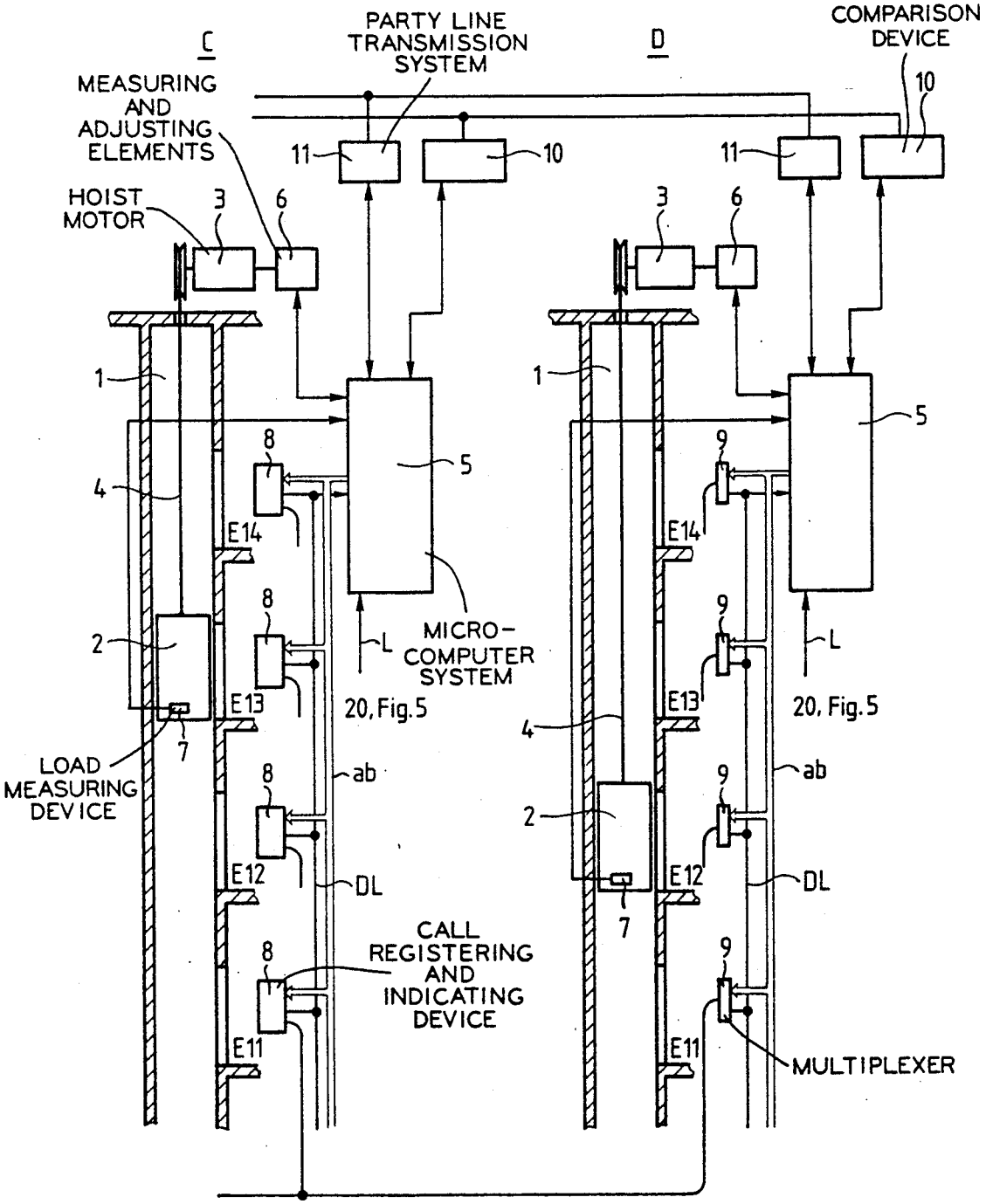
FIG. 1 is a schematic block diagram of a group control for two elevators of an elevator group.

In the FIG. 1, two elevators of a elevator group are designated by C and D. wherein each elevator includes a car 2 guided in an elevator shaft 1 and driven by a hoist motor 3 by way of a hoisting cable 4. In this example, fifteen floors E0 and E14 are served by the cars. The hoist motor 3 is controlled by a drive control, such as the control shown in the European Patent No. EP-B 0 026 406, wherein the target value generation the regulation functions and the stop initiation are realized by means of a microcomputer system 5. The system 5 is connected to measuring and adjusting elements 6 of the drive control. The microcomputer system 5 computes a sum which is also called operating costs corresponding to the waiting time of all passengers and this sum is made the basis of the call allocation procedure, as is for example shown in the application EP-A 0 356 731 mentioned above.

The car 2 includes a load measuring device 7 which is connected with the microcomputer system 5. Call registering and indicating devices 8, which are for example shown in the previously identified application EP-A 0 320 583 and which have decade keyboards, are provided on the floors by which calls for travels to desired target floors can be entered. The call registering and indicating devices 8 are connected by way of an address bus ab and a data input conductor DL with the microcomputer system 5. The call registering and indicating devices 8 of a floor are connected together and can be associated with more than one elevator of the group wherein, for example, those connected to the elevator C are connected by way of coupling members in the form of multiplexers 9 to the microcomputer system 5 of the elevator D. The microcomputer systems 5 of the individual elevators of the group are connected together by way of a comparison device 10, which is shown in the European Patent No. EP-B 0 50 304, and a party line transmission system 11, which is shown in the European Patent No EP-B 0 050 305, and together with the call registering and indicating devices 8 form a group control similar to the control shown in the aforementioned application EP-A 0 356 731. The call registering and indicating devices 8 are furthermore connected by way of conductors L to the microcomputer systems 5 as described below. A signal by which the microcomputer systems 5 can identify an actuated call registering and indicating device 8 can be transmitted by way of the conductors L.

Figure 2:
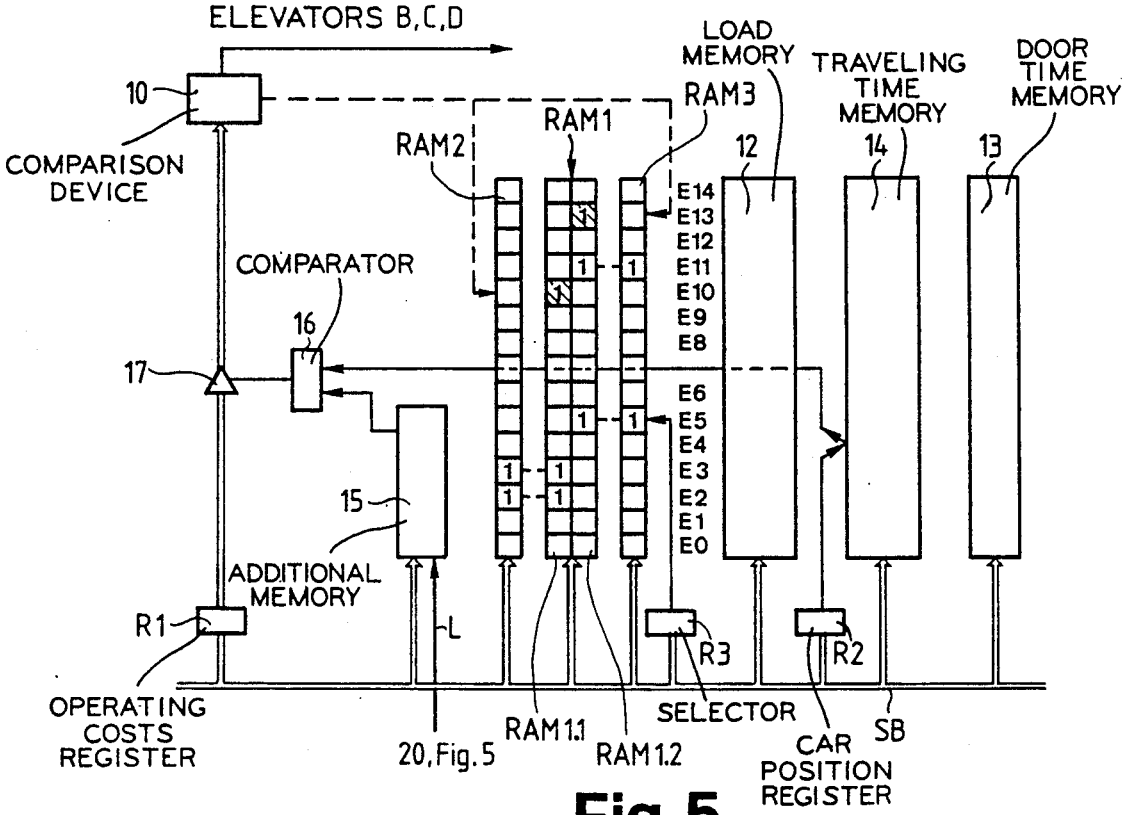
FIG. 2 is a schematic block diagram of a portion of the group control according to FIG. 1 showing a circuit according to the present invention associated with one car.

The portion of the microcomputer system 5, illustrated schematically in the FIG. 2 and which is associated for example with the elevator A. includes a floor call memory RAM1 and a first and a second call allocation memory RAM2 and RAM3 respectively. For each direction of travel, the memories possess storage places corresponding to the number of the floors; however only the memories associated with the upwards calls are illustrated. The floor call memory RAM1 consists of a first and a second memory portion, RAM1.1 and RAM1.2 respectively, wherein the calls identifying the entry floors are stored in the first memory portion RAM1.1 and the calls identifying the target floors are stored in the second memory portion RAM1.2. The first allocation memory RAM2 is associated with the first memory portion RAM1.1 and the second allocation memory RAM3 is associated with the second memory portion RAM1.2.

An operating costs register for the storage of the operating costs is denoted by R1 and a car position register is denoted by R2. A selector R3 in the form of a another register generates addresses which correspond to the floor numbers and by means of which the storage places of the memories RAM1.1, RAM1.2, RAM2 and RAM3 can be addressed. While the selector R3 indicates that floor at which the travelling car 2 could still stop, the car position register R2 indicates that floor in the region of which the car 2 is actually situated. The floor call memory RAM1, as well as the first and second call allocation memories RAM2 and RAM3, are read-write memories which are connected with a bus SB of the microcomputer system 5.

Memories 12 13 and 14 which are shown in the patent application EP-A 0 356 731 identified above are read-write memories in which data for the operating costs computation are stored Load values in the form of a number of persons are stored for each floor in the load memory 12. Such persons are situated in the respective car during a future stop or the travel past a floor, and the number can be calculated on the basis of the entered calls. In this case, load values formed from faulty call entries can be corrected through comparison with the values ascertained by the load measuring device 7. The door opening and closing times of the elevator concerned are stored for each floor in the door time memory 13, while the traveling times of the elevator car between each floor and each other floor are stored in the traveling time memory 14.

Denoted by 15 is an additional memory which is connected with the bus SB and in which are stored the times needed by a passenger at a floor for traversing the paths between the respectively actuated call registering and indicating device 8 and the shaft doors of the elevators. A comparator 16, which is for example formed by the processor of the microcomputer system 5, has inputs connected with the travelling time memory 14 and the additional memory 15. The operating costs register R1 is connected through a switching device 17 in the form of a tri-state buffer with the comparison device 10, wherein an activating lead of the tri-state buffer is connected to an output of the comparator 16.

Figure 3:
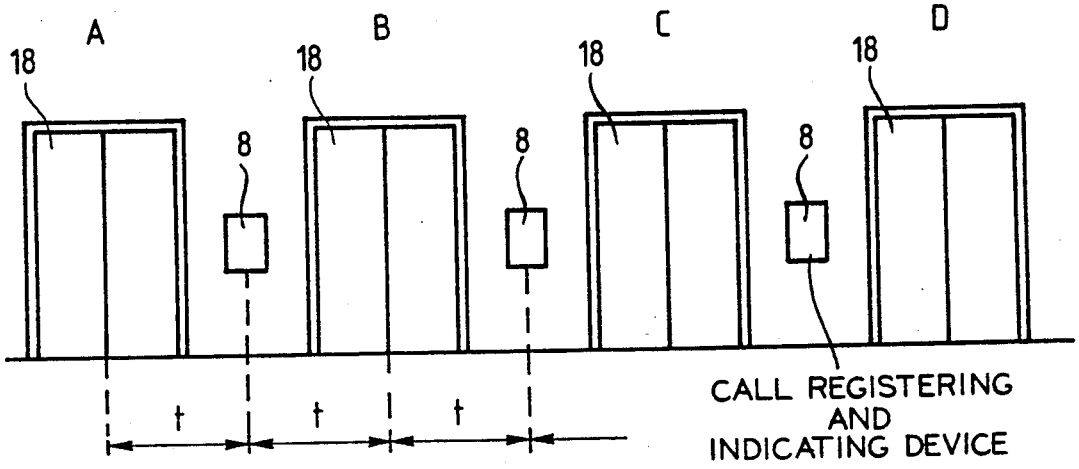
FIG. 3 is an elevational view of the call registering and indicating devices positioned at a floor for an elevator group consisting of four elevators.

The elevator shaft doors of the elevators A B, C and D of an elevator group shown by way of example in the FIG. 3, are denoted by 18 for a particular floor. The shaft doors 18 can have the same spacings between adjacent pairs and the call registering and indicating devices can be located in the center between each two adjacent shaft doors. The empirically derived time which a passenger needs for the travel along a path between the call registering and indicating device 8 actuated by him and the adjacent one of the shaft doors 18 is denoted by "t". In the arrangement shown in the example of FIG. 3, a passenger would need a time of "5t" to move to the indicated shaft door 18 upon allocation of the elevator D in response to the actuation of the call registering and indicating device 8 positioned between the elevators A and B.

The additional memories 15, associated with the elevators A, B. C and D as shown in the FIG. 4, include a number of storage places corresponding to the number of call registering and indicating devices 8 provided on a floor. Corresponding to the arrangement shown in the FIG. 3, the additional memories 15 each have three storage places which are denoted in the sequence of the elevators by AB, BC and CD. The stored times entered in the FIG. 4, result from the definition of the time "t" given in the description relating to FIG. 3 wherein the time "5t" mentioned by way of example is to be found in the storage place AB of the additional memory 15 associated with the elevator D.

Figure 5:
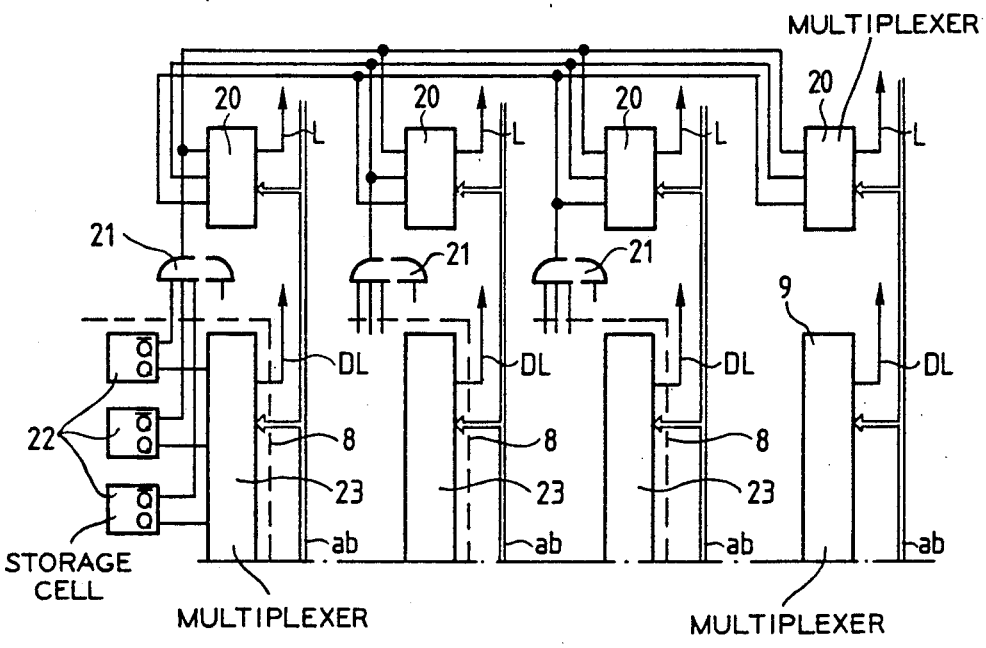
FIG. 5 is a schematic block diagram of a circuit connected to the memories of FIG. 4 for ascertaining which of the call registering and indicating devices is actuated on a floor.

Denoted by 20 in the FIG. 5 are multiplexers which are associated with the elevators and the call registering and indicating devices 8 of a floor and which have a number of inputs corresponding to the number of call registering and indicating devices 8 located on a floor. The inputs of all of the multiplexers 20 associated with the same call registering and indicating device 8 are connected together. One input of each of the multiplexers 20 is connected with an output of an associated AND gate 21. Inputs of the AND gate 21 are connected to inverting outputs Q of storage cells 22 of the associated call registering and indicating devices 8. The multiplexers 20 are connected to the address buses ab of the associated microcomputer systems 5 and at an output are connected (FIG. 2) by way of the conductor L with the additional memory 15 of the associated microcomputer system 5. The noninverting outputs Q of the storage cells 22 are, as is known from the application EP-A 0 320 583 previously mentioned or European Patent No. EP-B 0 246 395, connected with inputs of multiplexers 23 associated with the respective call registering and indicating devices 8 for the interrogation of calls entered on a floor.

Figure 4:
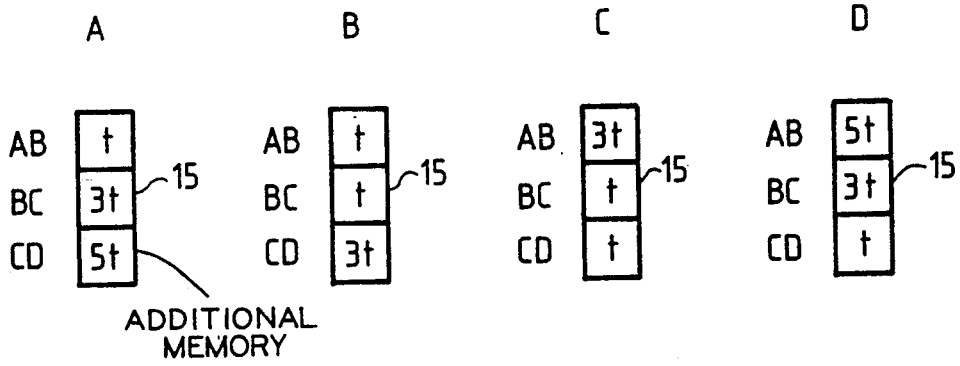
FIG. 4 is a schematic illustration of memories associated with the elevators for storing the times which a passenger needs for the paths between the call registering and indicating devices and the shaft doors.

The above described elevator group control operates as follows: After entry of a call, for example according to the data shown in the FIG. 2 a call on the floor E10 for the floor E13, a call identifying the entry floor is transferred into the first memory portion RAM1.1 and a call identifying the target floor is transferred into the second memory portion RAM1.2 of the floor call memories RAM1 of all of the elevator cars. Thereafter, the multiplexers 20 are interrogated for which it is assumed that the call from the floor E10 was entered by means of the call registering and indicating device 8 located between the elevators A and B. In this case, the output of the associated AND gate 21 and thereby also the inputs of all of the multiplexers 20 associated with the actuated call registering and indicating device 8 become logic "0" (FIG. 5). Upon the generation of the address associated with the respective input, the microprocessors of the microcomputer systems 5 interpret the signal "0" which is then carried on the conductors L as requiring that the content of the storage place AB of the additional memory 15 must be applied to the one input of the comparator 16 (FIGS. 2 and 4). Thereafter the associated travelling time is read from the travelling time memory 14, in dependence on the car position contained in the car position register R2 and the address of the call entry floor E10, and is applied to the other input of the comparator 16.

Let it now be assumed that the travelling time of the car of the elevator D is less than the time "5t" stored in the storage place AB of the additional memory 15. In this case, the logic state at the output of the comparator 16 changes in such a manner that the switching device 17 is switched into a high resistance state and the operating costs register R1 is disconnected from the comparison device 10. After the load values of the load memory 12 have been corrected in accordance with the newly entered call on the floor E10, the operating costs for the entry and target floors of the new call are computed for all elevators, for which a formula is used for example which is disclosed in the previously identified application EP-A 0 356 731. In this case, it is presumed that due to the possible new stops taking place at the entry and target floors not only the waiting times of the new passengers would be created, but also the waiting times of all traffic participants of already allocated calls of the elevator concerned would be increased. As already mentioned in the preceding, the computer takes door opening and closing times from the door time memory 13, the number of the persons already situated in the car from the load memory 12 and the travelling times of the car from the instantaneous position to the entry or target floor from the travelling time memory 14 for the operating costs computation.

Immediately after the computation, the operating costs are transferred into the operating costs register R1 and are compared with the operating costs of the other elevators by means of the comparison device 10, according to the method shown in the previously identified patent EP-B 0 050 304, wherein the elevator D is excluded from the comparison as described in the preceding. Let it now be assumed that the elevator A displays the lowest operating costs so that an allocation instruction is entered (dashed arrows, FIG. 2) for floor E10 in the first call allocation memory RAM2 and for the floor E13 in the second call allocation memory RAM3. Immediately after the allocation, the selected elevator A and its position are indicated in an indicating field of the call registering and indicating device 8 actuated by the passenger whereupon the passenger moves to the correspondingly identified shaft door 18 and arrives there before the car arrives.

If the selector R3, in continuation of an assumed upward travel of the car situated for example in the region of the floor E4, switches over to the newly allocated floor E10, then the stopping of the car is initiated on reaching the brake onset point according to the drive control described in the previously identified patent EP B 0 026 406 for example.

In accordance with the provisions of the patent statutes the present invention has been described in what is considered to represent its preferred embodiment. However, it should be noted that the invention can be practiced otherwise than as specifically illustrated and described without departing from its spirit or scope.

What is claimed is:

1. A group control apparatus for elevators with immediate allocation of target calls in dependence on the call entry location on a floor includes call registering and indicating devices located on the floors and having a keyboard for the entry of calls for desired target floors, floor call memories associated with the elevators of the group and connected with the call registering and indicating devices wherein on the entry of a call on a floor, a call identifying the entry floor and a call identifying the target floor are stored in the floor call memories, computers associated with the elevators of the group wherein each computer computes operating costs corresponding to the waiting times of passengers from data specific to the elevator, an operating costs register connected with the computer, a comparison device connected to the operating costs register, and call allocation memories associated with the floor call memory, wherein the operating costs are compared one with the other and the floor call concerned is allocated through entry of an allocation instruction into the call allocation memories to that elevator car which has the lowest operating costs, and wherein the elevator concerned and its position are indicated on an indicating field of the actuated call registering and indicating device immediately after the call allocation comprising:

an additional memory for storing times needed by a passenger to traverse the paths between an actuated call registering and indicating device and the shaft doors of an allocated elevator car for each elevator car of an elevator group;

a comparator having inputs connected to an output of said additional memory and to an output of a travelling time memory for an associated one of the elevator cars; and an operating costs register connected through a switching device to a comparison device, said comparator having an output connected to an activating lead of said switching device whereby for an elevator car travelling time stored in said travelling time memory and dependent on the car position and the call input floor and being less than the time needed by a passenger to move from an actuated call registering and indicating device to the shaft door of the elevator concerned, said switching device disconnects said operating costs register from said comparison device and the associated elevator car is excluded from a comparison of operating costs.

2. The apparatus according to claim 1 wherein said switching device is formed of a tri-state buffer having an activating lead connected to the output of said comparator.

3. The apparatus according to claim 1 wherein a floor call memory call allocation memories, a load memory, said travelling time memory a car position register said operating costs register and a computer are components of microcomputer systems associated with the elevator cars, and said additional memory and said comparator are further components of the microcomputer systems, wherein said additional memory has storage places corresponding to the number of the call registering and indicating devices on a floor.

4. The apparatus according to claim 3 wherein the call registering and indicating devices have storage cells for the storage of the calls entered on the floors and including:

a multiplexer for each elevator car and each floor, each said multiplexer having inputs corresponding to the number of the call registering and indicating devices on a floor, and said inputs of all said multiplexers being connected together which are associated with the same call registering and indicating device, the call registering and indicating devices having storage cells with outputs connected with inputs of an AND gate, an output of said AND gate being connected with an associated one of said inputs of said multiplexer and said multiplexer being connected to an address bus of the associated microcomputer system and an output of said multiplexer being connected to said additional memory by a conductor.

5. A group control apparatus for elevators with immediate allocation of target calls in dependence on the call entry location on a floor includes call registering and indicating devices located on the floors and having a keyboard for the entry of calls for desired target floors, a floor call memory connected with the call registering and indicating devices wherein on the entry of a call on a floor, a call identifying the entry floor and a call identifying the target floor are stored in the floor call memory, a computer for computing operating costs corresponding to the waiting times of passengers from data specific to the elevator, an operating costs register connected with the computer, a comparison device connected to the operating costs register, and call allocation memories associated with the floor call memory, wherein the operating costs for elevators in the group are compared one with the other and the floor call concerned is allocated through entry of an allocation instruction into the call allocation memories to that elevator car which has the lowest operating costs, and wherein the elevator concerned and its position are indicated on an indicating field of the actuated call registering and indicating device immediately after the call allocation, comprising:

an additional memory for storing times needed by a passenger to traverse the paths between an actuated call registering and indicating device and the shaft doors of an allocated elevator car;

a comparator having inputs connected to an output of said additional memory and to an output of a travelling time memory for an associated one of the elevator cars; and an operating costs register connected through a switching device to a comparison device, said comparator having an output connected to an activating lead of said switching device whereby for an elevator car travelling time stored in said travelling time memory and dependent on the car position and the call input floor and being less than the time needed by a passenger to move from an actuated call registering and indicating device to the shaft door of the elevator concerned, said switching device disconnects said operating costs register from said comparison device and the associated elevator car is excluded from a comparison of operating costs.

* * * * *